US007689140B2

(12) United States Patent
Takesawa et al.

(10) Patent No.: US 7,689,140 B2
(45) Date of Patent: Mar. 30, 2010

(54) BLADE CLEANING JIG

(75) Inventors: Yohichi Takesawa, Singapore (SG); Eiichi Kido, Nara (JP); Fumito Mizoguchi, Beijing (CN)

(73) Assignee: Sharp Kabushiki Kaisha, Osaka (JP)

( * ) Notice: Subject to any disclaimer, the term of this patent is extended or adjusted under 35 U.S.C. 154(b) by 662 days.

(21) Appl. No.: 11/599,395

(22) Filed: Nov. 15, 2006

(65) Prior Publication Data

US 2007/0110470 A1 May 17, 2007

(30) Foreign Application Priority Data

Nov. 15, 2005 (JP) ..... 2005-330659

(51) Int. Cl.
*G03G 21/00* (2006.01)

(52) U.S. Cl. ..... 399/99; 399/222; 399/274; 399/284

(58) Field of Classification Search ..... 399/99, 399/274, 284, 222
See application file for complete search history.

(56) References Cited

U.S. PATENT DOCUMENTS

2001/0005458 A1* 6/2001 Yamanaka et al. ..... 399/43

FOREIGN PATENT DOCUMENTS

| | | |
|---|---|---|
| JP | 57-93370 | 6/1982 |
| JP | 2-64975 | 5/1990 |
| JP | 5-150638 A | 6/1993 |
| JP | 2001-175078 | 6/2001 |
| JP | 2004-20877 | 1/2004 |

OTHER PUBLICATIONS

Machine Translation JP 2001-175078.*

* cited by examiner

*Primary Examiner*—David P Porta
*Assistant Examiner*—Bryan P Ready
(74) *Attorney, Agent, or Firm*—Nixon & Vanderhye, PC

(57) ABSTRACT

A blade cleaning jig includes a cleaning portion and a gripping portion. The cleaning portion includes a support body of stainless steel or the like and polishing tape provided on the upper face of this support body, and moreover a cushioning material is inserted between the support body and the polishing tape. A protective member for preventing damage to the surface of a developer roller is attached to the entire lower face of the support body. This protective member is attached bent at a circumferential end portion such that the protective member covers from the lower face of the support body via a circumferential edge portion to an upper face circumferential edge portion.

24 Claims, 5 Drawing Sheets

BLADE CLEANING JIG

BACKGROUND OF THE TECHNOLOGY

This application claims priority under 35 U.S.C. §119(a) on Japanese Patent Application No. 2005-330659 filed in Japan on Nov. 15, 2005, the entire contents of which are hereby incorporated by reference.

The present technology relates to a blade cleaning jig that is applied in an image forming apparatus such as a copier, printer, or facsimile machine that forms an image by electrophotography. More specifically, the present technology relates to a blade cleaning jig that is effective for removal of toner that is affixed to a toner layer control blade, in a development apparatus in which a non-magnetic one-component developer is used.

In general, in a non-magnetic one-component developing method, regardless of whether the toner is magnetic or non-magnetic, a thin layer of one-component toner that has been charged is formed on a developer support, and with rotation of a developer roller, this thin layer is conveyed to a developing position that faces a photosensitive drum on which a latent image has been formed, and thus the latent image on the photosensitive drum is developed. In this case, the question of how to stably form a thin toner layer with uniform layer thickness and uniform charging on the developer roller is important for obtaining a good image.

In general, charging of the toner layer on this developer roller and thin layer formation are performed by a toner layer control blade that has been pressed against the developer roller with a predetermined pressure. In this toner layer charging and thin layer formation, there are cases in which toner becomes firmly adhered to the toner layer control blade due to use for a long period, so a good toner layer cannot be formed, which leads to image degradation. That is, the toner layer control blade continues to make contact with the developer roller with a predetermined pressure, and due to environmental factors or the like such as frictional heat, that pressure, or internal temperature of the apparatus, in the region where the toner layer control blade makes contact with the developer roller and the vicinity thereof, toner adheres (affixes) to the blade surface.

This affixed material, at first, is only slightly present like a thin film that has been spread on the surface, in an amount that is not particularly a problem even for image formation, but it grows with accumulated usage, and eventually has an adverse effect on images.

That is, the chargeability of the toner is worsened by the toner layer control blade due to the affixed material, and the affixed material plugs a toner inflow port between the developer roller and the toner layer control blade, or alternatively forms mechanically uneven portions in the surface that makes contact with the developer roller, leading to a decrease in toner layer thickness locally or as a whole, or local slippage (an increase in layer thickness), and it becomes impossible to form a uniform toner layer. As a result, a decrease in the density in the image, partial white streaks, or partial black streaks (in the case of a monochrome image) and the like occur.

Accordingly, in order to address these problems, development apparatuses have been proposed that clean toner affixed material on the toner layer control blade (for example, see JP S57-93370A).

The development apparatus disclosed in JP S57-93370A has a configuration in which a slidable cleaning member is provided between the developer roller and the toner layer control blade, and affixed toner is removed by sliding this cleaning member. That is, the cleaning member is configured with a thin plate member, where the front end of the cleaning member is extended to the top of the toner layer control blade, and at the rear end of the cleaning member, a tab is installed with the rear end extended outside from a groove provided in a developer container side wall. Also, the cleaning member is slidably supported and guided in the widthwise direction of the developer roller by copper wiring that has been stretched in the developer container in the center portion of the cleaning member. When foreign matter has become lodged between the toner layer control blade and the developer roller, by grasping the tab and sliding the cleaning member in the widthwise direction of the developer roller, the foreign matter is removed by the end of the cleaning member.

With the development apparatus disclosed in above JP S57-93370A, it is necessary to insure space to dispose the cleaning member inside the developer container. Also, because it is necessary to adopt a slidable structure for the cleaning member by stretching copper wiring in the development container or the like, there are the problems that the number of components increases, and the structure of the development apparatus becomes more complicated. Further, because the cleaning member is separately installed in the development apparatus, there is the problem that it cannot be applied in an existing development apparatus that does not have such a cleaning member.

SUMMARY OF THE TECHNOLOGY

The present technology was made to address the problems described above, and it is an object thereof to provide a blade cleaning jig that is applicable also in an existing developer apparatus, by forming a jig that cleans a toner layer control blade as a separate body from the developer apparatus.

The blade cleaning jig removes toner affixed to a toner layer control blade that controls the thickness of a toner layer on the surface of a developer support by pressing against the surface of the developer support, and includes a cleaning portion that is inserted from a space between an opening portion of a housing that supports the developer support and the developer support and penetrates to the contact location of the toner layer control blade and the developer support, and a gripping portion provided on the base end of the cleaning portion. The cleaning portion includes a flexible support body, and a polishing body provided in a portion on the upper face of the support body, that is where contact is made with the toner layer control blade, and the support body is formed in a curved shape so as to follow along the surface of the developer support. Here, an elastic plate such as a stainless steel plate or the like can be used as the support body, and polishing tape can be used as the polishing body.

This blade cleaning jig is movable in back and forth in the widthwise direction of the developer support in a state with the cleaning portion inserted to the contact location.

With a blade cleaning jig having such a configuration, it is not constantly installed in the development apparatus, so it can be used only when necessary. For example, when forming an image, if a decrease in the density in the image, partial white streaks, or partial black streaks (in the case of a monochrome image) or the like occur in the image, toner affixed to the toner layer control blade may be removed using the blade cleaning jig. That is, the cleaning portion is inserted from the space between the opening portion of the housing and the developer support, to the contact location of the toner layer control blade and the developer support, and then moved in the widthwise direction of the developer support, so that it is possible to reliably remove toner affixed in the vicinity of the contact location of the toner layer control blade.

In this case, cushioning material may be inserted between the support body and the polishing body. Low-repulsive material, for example urethane foam, can be used for the cushioning material. Due to such cushioning material being inserted, the polishing body is pressed such that it covers the contact location of the toner layer control blade, so that affixed toner can be reliably removed.

A protective member for preventing damage to the surface of the developer support is attached to the lower face of the support body. Tape constituted from fluorocarbon resin can be used for the protective member, or the lower face of the support body may be coated with fluorocarbon resin. Also, the protective member may be provided from the lower face of the support body via a circumferential edge portion to an upper face circumferential edge portion of the support body. By covering from the circumferential edge portion of the support body to the upper face with the protective member, there is no damage to the surface of the developer support even if a corner hits the surface of the developer support when inserting the cleaning portion. Also, when both ends of the cleaning portion have a rounded shape, the damage-prevention effect can be further improved.

Also, in the blade cleaning jig, the cleaning portion inserted to the contact location can be positioned by causing the gripping portion to make contact with the housing in a state with the cleaning portion inserted from the space between the opening portion of the housing and the developer support. That is, the gripping portion not only has a gripping function for a worker to operate the cleaning portion by gripping the gripping portion, it also has a role as a positioner of the cleaning portion. Thus, even if the worker cannot see the position of the toner layer control blade from the opening portion of the housing, it is possible to reliably insert the polishing tape to the contact location of the toner layer control blade.

According to the blade cleaning jig, the blade cleaning jig is not installed in the development apparatus, so it can also be used in a preexisting development apparatus. When using the blade cleaning jig, the cleaning portion is inserted from the space between the opening portion of the housing and the developer support, to the contact location of the toner layer control blade and the developer support, and then moved in the widthwise direction of the developer support, so that it is possible to reliably remove toner affixed in the vicinity of the contact location of the toner layer control blade. In this case, cushioning material is present between the support body and the polishing body, and the polishing body is pressed such that it covers the contact location of the toner layer control blade, so that affixed toner can be reliably removed. Also, a protective member is attached to the entire lower face of the support body and from the lower face via the circumferential edge portion to the upper face of the support body, so there is no damage to the surface of the developer support even if a corner hits the surface of the developer support when inserting the cleaning portion. Further, the gripping portion not only has a gripping function for a worker to operate the cleaning portion by gripping the gripping portion, it also has a role as a positioner of the cleaning portion so even if the worker cannot see the position of the toner layer control blade from the opening portion of the housing, it is possible to reliably insert the polishing tape to the contact location of the toner layer control blade.

DESCRIPTION OF THE PREFERRED EMBODIMENTS

Below, an embodiment of the present technology will be described with reference to the accompanying drawings.

<Description of Development Apparatus>

Figure 1:
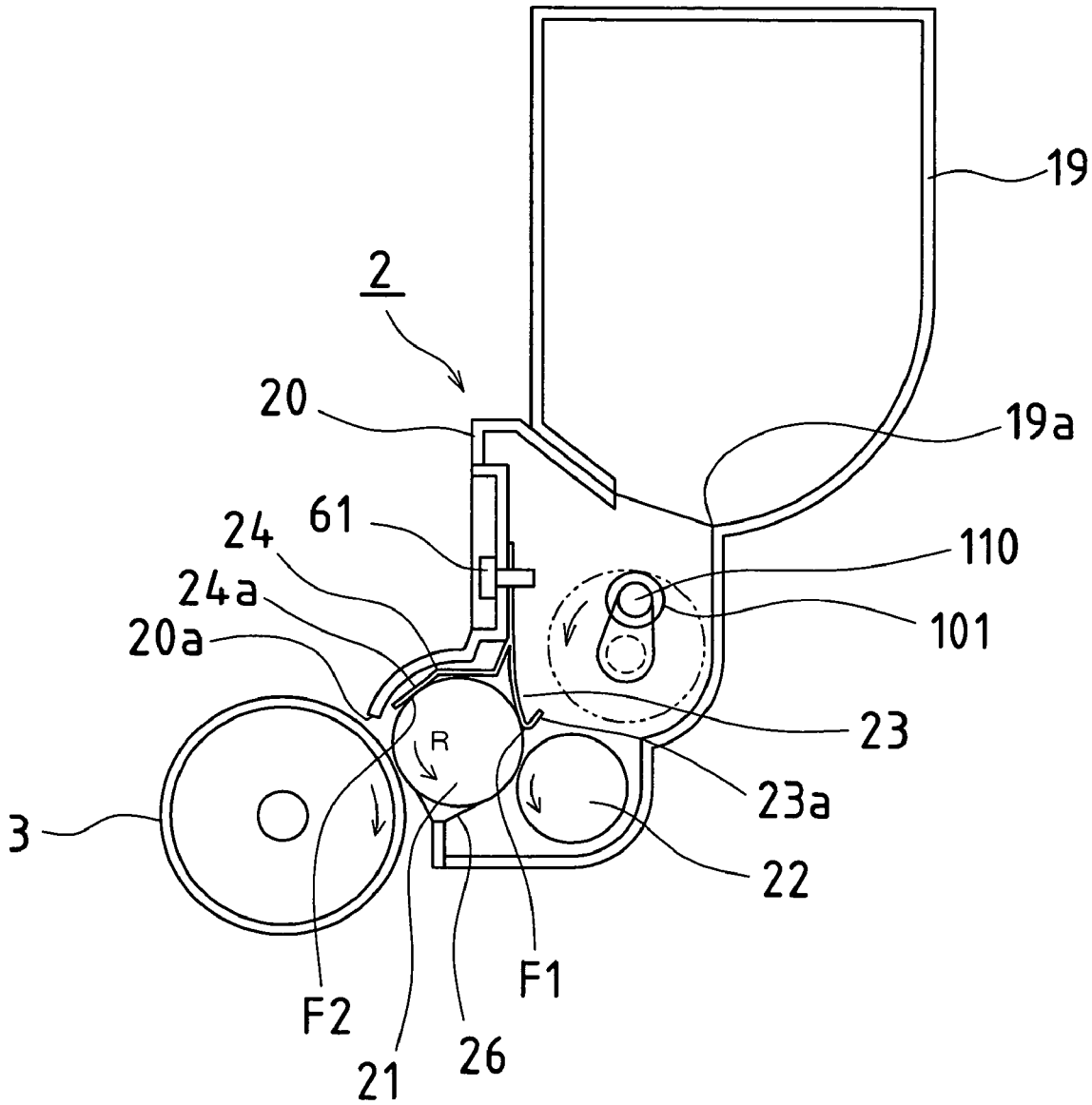
FIG. 1 is a schematic diagram that shows an ordinary example configuration of a non-magnetic one-component development apparatus in which a blade cleaning jig can be used.

FIG. 1 is a schematic diagram that shows an ordinary example configuration of a non-magnetic one-component development apparatus in which a blade cleaning jig can be used (hereinafter, referred to as the "development apparatus").

This development apparatus 2 is provided with a development tank (corresponding to a housing in the claims) 20, and a toner cartridge 19 installed on the top side of the development tank 20 such that the toner cartridge 19 can be installed or removed. The toner cartridge 19 stores toner, and this toner is supplied by allowing the toner to naturally descend from a toner supply port 19*a* into the development tank 20.

Inside the development tank 20, in an opening portion 20*a* of the development tank 20, a development roller 21 (corresponding to a developer support in the claims) is disposed horizontally (disposed perpendicular to the paper face) while facing a photosensitive drum 3, and a toner supply roller 22 is disposed horizontally while making contact with the development roller 21. In the development roller 21, a first toner layer control blade 23 and a second toner layer control blade 24 for controlling the layer thickness of toner affixed to the roller are disposed. In the vicinity of the top of the toner supply roller 22 disposed in this manner, and in the vicinity of the first and second toner layer control blades 23 and 24, a stainless steel shaft 110 that is a weighting member for stirring and conveying toner is disposed, and is inserted into a coil spring 101 such that it can rotate, and with the angle of that rotation controlled to a predetermined angle. However, the stainless steel shaft 110 and the coil spring 101 are not relevant portions, and thus a detailed description of their configuration is omitted here.

The first toner layer control blade 23 and the second toner layer control blade 24, in a state with the base ends thereof overlapping, are fixed to a frame portion of the development tank 20 with a screw 61 or the like, and the front end of the first toner layer control blade 23 is disposed in a cantilever-like form in which the first toner layer control blade 23 is provided extended toward the upstream side in a direction of rotation R of the development roller 21. That front end is formed bent in an approximately V-like shape, and that bent portion 23*a* is pressed against the surface (a contact location F1) of the developer roller 21. On the other hand, the front end of the second toner layer control blade 24 is disposed in a cantilever-like form in which the second toner layer control blade 24 is provided extended toward the downstream side in a direction of rotation R of the development roller 21. The center portion thereof is bent in approximately an upside-down v-like shape, and a bent front end portion 24*a* is pressed against the surface (a contact location F2) of the developer roller 21.

A toner supply roller 22 is pressed in contact with the developer roller 21, and the rotational direction of the toner supply roller 22 is a direction R that is the same as the developer roller 21, that is, the movement directions of the surface of the two rollers are opposite to each other in a portion opposing the developer roller 21.

Voltage is applied to the toner supply roller 22 from a bias power source (not shown), and that voltage is, for example, in the case of negatively charged toner, a large bias voltage more to the negative side in the direction that electrically pushes toner towards the developer roller 21. The toner, which is charged by frictional contact by the toner supply roller 22 and is supplied to the developer roller 21 by the bias voltage, is conveyed to a position where the first toner layer control blade 23 makes contact by rotational operation of the developer roller 21. The toner on the developer roller 21 is controlled to a predetermined electrical charge quantity and thickness by the first toner layer control blade 23, and after further being controlled by the second toner layer control blade 24, is conveyed to a developer region (portion opposing the photosensitive drum 3, on which an electrostatic latent image has been formed), and then proceeds to the development process.

Undeveloped toner on the developer roller 21 that was not used in the development process returns inside the development tank 20 due to rotation of the developer roller 21, but the electrical charge of toner remaining on the developer roller 21 is removed by a charge removal apparatus 26 installed before the toner supply roller 22, and that remaining toner is peeled away by contact of the toner supply roller 22 and the developer roller 21 and recovered, and reused.

The photosensitive drum 3 is a negatively charged drum wherein a conductive base material is grounded, and the surface potential has been charged to −550 V, for example. The photosensitive drum 3 rotates with a circumferential velocity Va (for example, 150 mm/s) in the direction of the arrow in FIG. 1.

The developer roller 21 is a conductive elastic roller constituted from conductive urethane rubber, wherein a conductive agent such as carbon black has been attached to the surface of a cylindrical member, and rotates with a circumferential velocity Vb (for example, 225 mm/s) in the direction of the arrow in FIG. 1. A voltage E1 (for example, −300 V) from a developer bias power source is applied via a shaft of an unshown conductive support body (such as stainless steel or conductive resin) to the developer roller 21.

The toner supply roller 22 is constituted from conductive urethane rubber used both for toner stirring and toner removal after development, and rotates with a circumferential velocity Vc (for example, 133 mm/s) in the direction of the arrow in FIG. 1. A voltage E2 (for example, −400 V) from a supply bias power source is applied via a shaft of an unshown conductive support body (such as stainless steel or conductive resin) to the toner supply roller 22.

Non-magnetic one-component toner that has been preliminarily negatively charged by the supply roller 22 and moved to the surface of the developer roller 21 is conveyed to the positions where the first and second toner layer control blades 23 and 24 make contact by rotation of the developer roller 21.

The first and second toner layer control blades 23 and 24 are conductive (such as stainless steel, phosphor bronze, or conductive resin) plate-like members with a thickness of 0.1 mm, have a cantilever plate spring structure as described above, and contact the developer roller 21 with a line pressure of about 15 to 30 gf/cm. A voltage E3 (for example, −400 V) from an unshown bias power source is applied to the first and second toner layer control blades 23 and 24.

The toner layer on the developer roller 21, after the toner-affixing quantity and the toner charge quantity are controlled to a predetermined quantity by the first and second toner layer control blades 23 and 24, is conveyed to a development region that contacts and opposes the photosensitive drum 3 by rotation of the developer roller 21, and contact reverse development is performed.

—Description of Blade Cleaning Jig—

Figure 2:
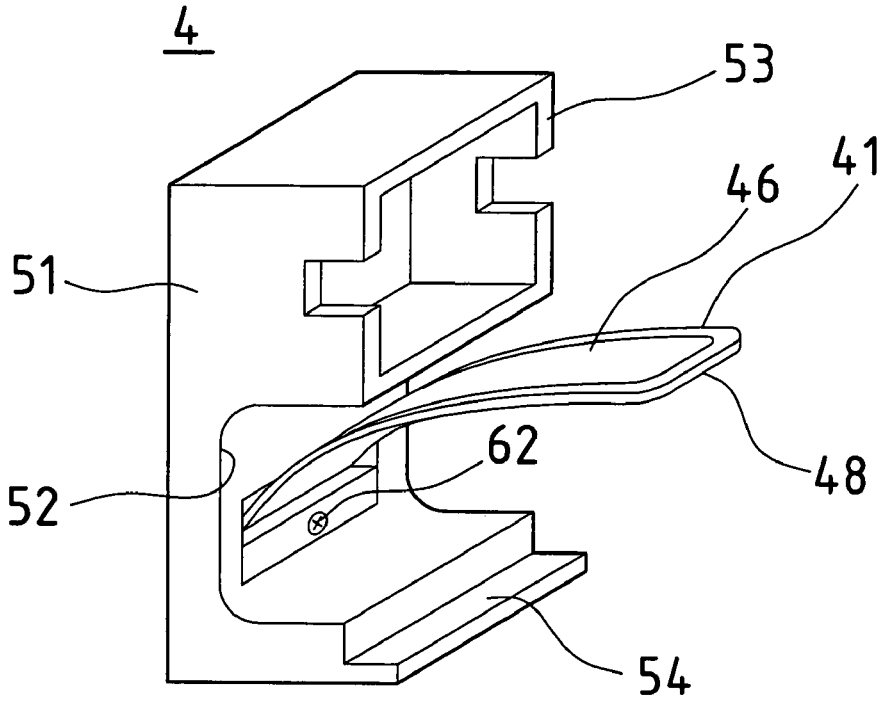
FIG. 2 is a perspective view that shows an embodiment of the blade cleaning jig.
Figure 3:
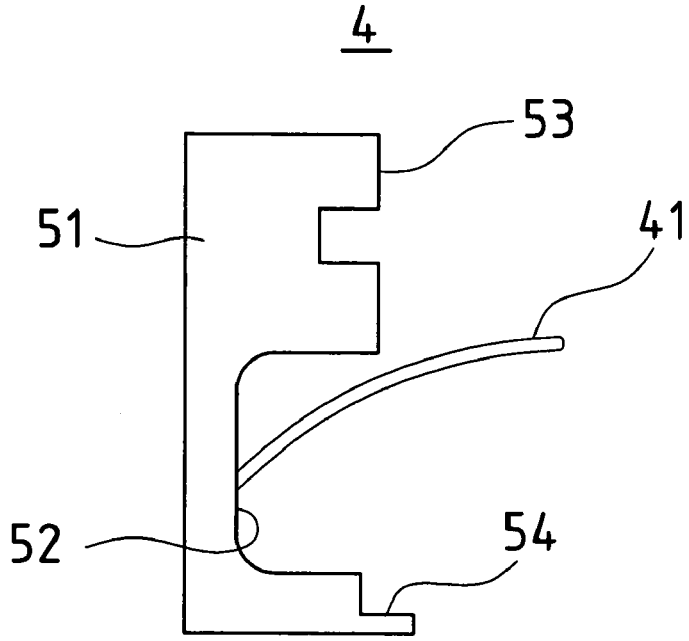
FIG. 3 is a side view that shows an embodiment of the blade cleaning jig.

FIG. 2 is a perspective view that shows an embodiment of a blade cleaning jig 4 for removing toner fixed to the first toner layer control blade 23 and the second toner layer control blade 24 in the development apparatus 2 with the above configuration. FIG. 3 is a side view of the same.

The blade cleaning jig 4 is provided with a cleaning portion 41 that is inserted from a space between an opening portion 20*a* of the development tank 20 and the developer roller 21, and thus allowed to enter between contact locations F1 and F2 (see FIG. 1) of the first and second toner layer control blades 23 and 24 and the surface of the developer roller 21, and a gripping portion 51 provided on the base end of the cleaning portion 41.

Figure 4:
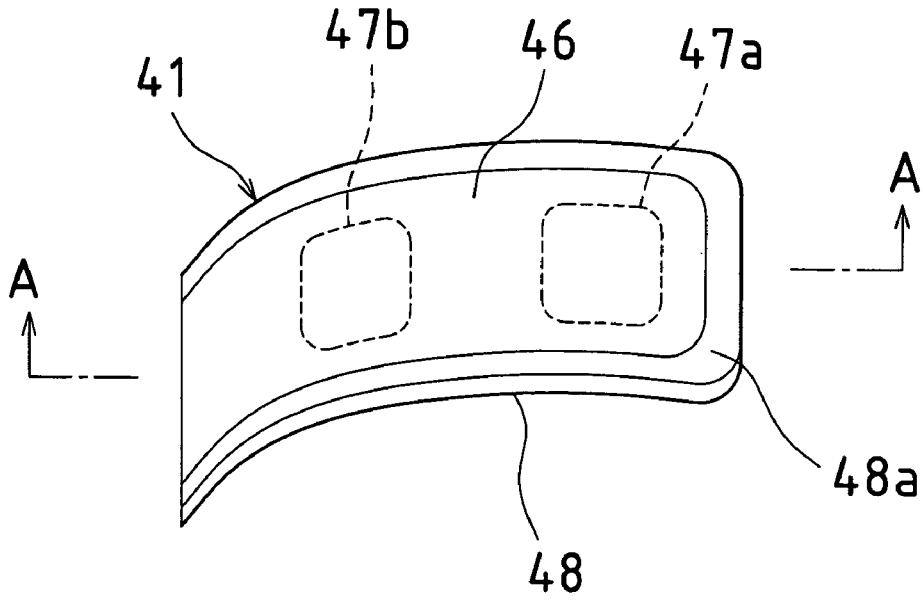
FIG. 4 is a perspective view that shows an enlarged view of a cleaning portion of the blade cleaning jig.
Figure 5:
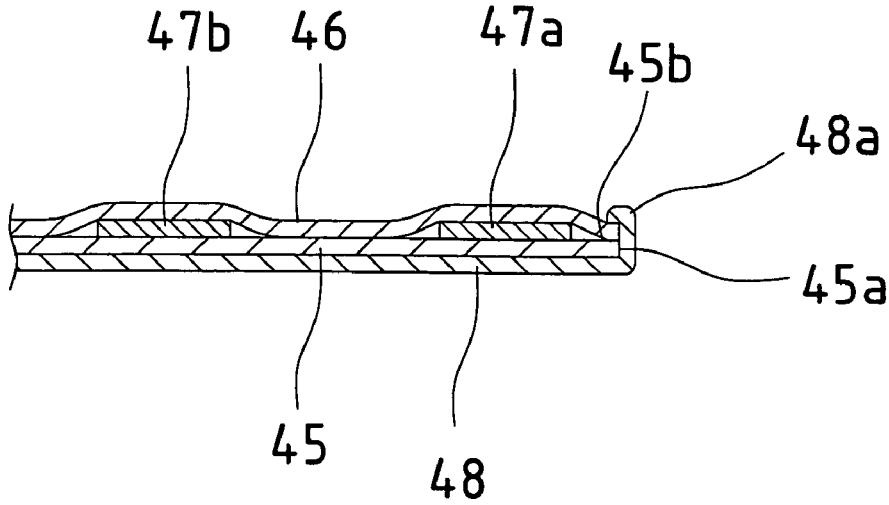
FIG. 5 is a cross-sectional diagram taken along line A-A in FIG. 4.

FIG. 4 is a perspective view that shows an enlarged view of the cleaning portion 41, and FIG. 5 is a cross-sectional diagram taken along line A-A in FIG. 4.

The cleaning portion 41 includes a support body 45 that has flexibility, and a polishing body 46 provided in the upper face of the support body 45. Cushioning material 47*a* and 47*b* are inserted at the locations that make contact with the first and second toner layer control blades 23 and 24 respectively, which are between the support body 45 and the polishing body 46.

The support body 45 is, for example, a stainless steel rectangular plate member with a thickness of 0.1 mm, and is formed in a curved shape in advance in order to easily follow the surface of the developer roller 21. Both end portions of the support body 45 have a rounded shape. By adopting a rounded shape for the end portions, it is possible to prevent damaging the surface of the developer roller 21.

It is important to decide the thickness of the support body 45 and the material characteristics of the plate member with focus on having mechanical strength such that when inserting between the first toner layer control blade 23 and the second toner layer control blade 24 and when cleaning (when moving in the widthwise direction of the developer roller 21), the first toner layer control blade 23 and the second toner layer control blade 24 do not deform. Accordingly, it is preferable that the thickness of the support body 45 and the material characteristics of the plate member are the same as those of the first toner layer control blade and the second toner layer control blade. Also, it is important that the support body is an elastic body, because the polishing body 46 for removing toner fixed to the blade makes contact with the fixed toner.

In the polishing body 46, it is possible to use polishing tape, for example.

Foam material with a thickness of 0.5 to 5.0 mm can be used for the cushioning material 47*a* and 47*b*, and it is preferable to use low-repulsive urethane foam. It is important to decide the thickness such that when inserting between the first toner layer control blade 23 and the second toner layer control blade 24 and when cleaning (when moving in the widthwise direction of the developer roller 21), the first toner layer control blade 23 and the second toner layer control blade 24 do not deform. The polishing body 46 is pressed such that it covers the contact locations of the toner layer control blades 23 and 24 (the bent portion 23*a* and the bent end portion 24*a*), so that it is possible to reliably remove fixed toner on the blade.

Also, a protective member 48 for preventing damage to the surface of the developer roller 21 is attached to the entire lower face of the support body 45. For the protective member 48, for example, tape constituted from fluorocarbon resin can be used, and the fluorocarbon resin may directly coat the entire lower face of the support body 45. Also, a circumferential end portion 48*a* of the protective member 48 is attached bent such that it covers from the lower face of the support body 45 via a circumferential edge portion 45*a* to an upper face circumferential edge portion 45*b* of the support body 45. By covering the support body 45 from the circumferential edge portion 45*a* to the upper face circumferential edge portion 45*b* with the protective member 48 in this manner, even if a corner hits the surface of the developer roller 21 when inserting the cleaning portion 41, there is no damage to the surface of the developer roller 21.

The gripping portion 51 is formed in a box-like shape as a whole, and is formed in an approximately E-like shape when viewed from the side, wherein the shape sinks far inside from one side (the right side in FIGS. 2 and 3) in the center portion in the vertical direction. In an inner wall face 52*a* of that concave groove portion 52, the base end of the cleaning portion 41 is supported and fixed with a screw 62 or the like.

The concave groove portion 52 is formed in a shape that can engulf the developer roller 21, and an upper curved frame 20*b* (see FIG. 6) of the development tank 20 that covers the upper side of the developer roller 21. Also, in the upper side of the concave groove portion 52, a front end face 53 is formed such that it makes contact with an upper frame portion 20*c* continuing from the upper curved frame portion 20*b* of the development tank 20.

Also, on the lower side of the concave groove portion 52, an approximately L-shaped stepped portion 54 is provided. This stepped portion 54 is formed in a shape that fits together with a lower frame portion 20*d* (see FIG. 6) of the opening portion 20*a* of the development tank 20.

The gripping portion 51 with such a shape is formed with synthetic resin such as vinyl chloride resin or polypropylene resin.

Figure 6:
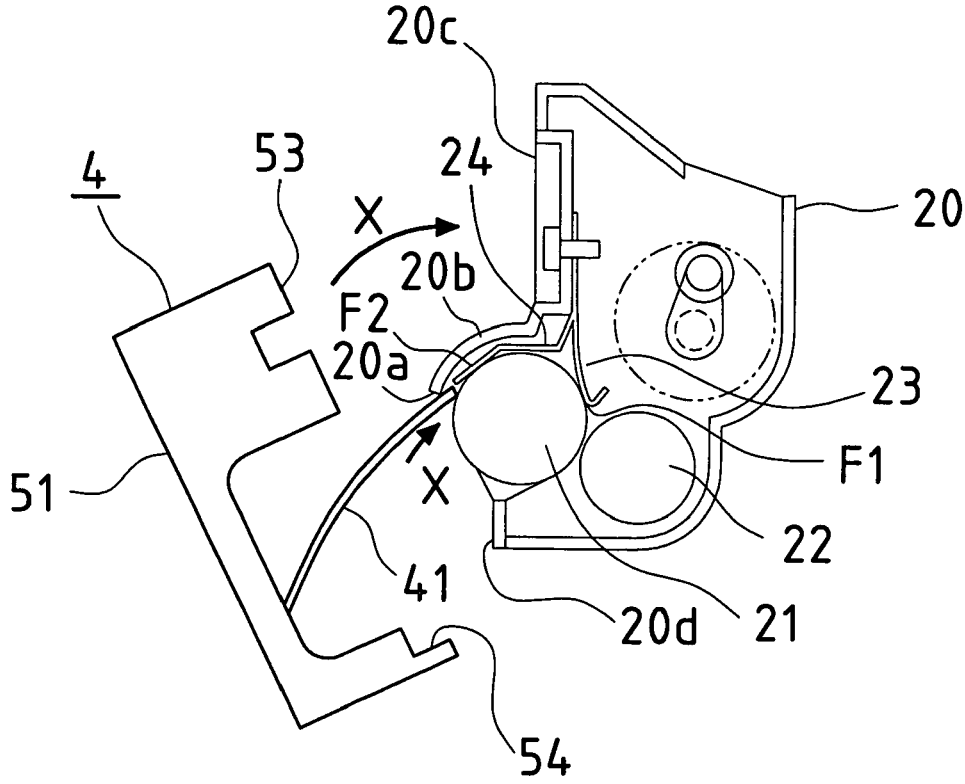
FIG. 6 is an explanatory diagram that shows the procedure of removing toner affixed to a toner layer control blade of a development apparatus using the blade cleaning jig.
Figure 7:
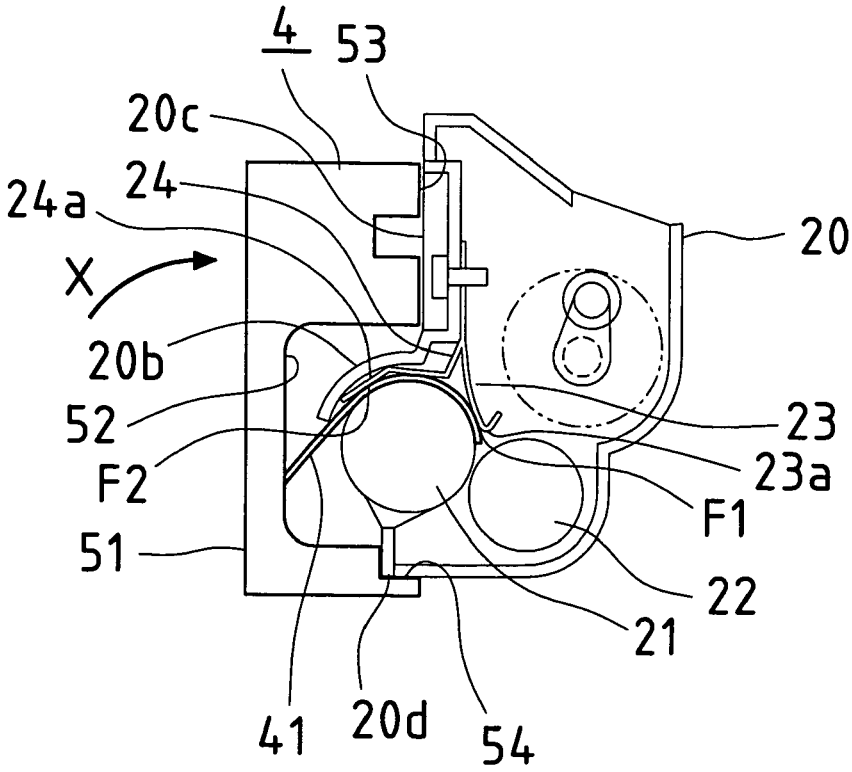
FIG. 7 is an explanatory diagram that shows the procedure of removing toner affixed to a toner layer control blade of a development apparatus using the blade cleaning jig.

Next is a description of the procedure for removing toner affixed to the contact locations (the bent portion 23*a* and the bent end portion 24*a*) of the toner layer control blades 23 and 24 of the development apparatus 2 using the blade cleaning jig with the above configuration, with reference to FIGS. 6 and 7.

A worker, holding the gripping portion 51 of the blade cleaning jig 4, inserts the cleaning portion 41 from the space between the opening portion 20*a* of the development tank 20 and the developer roller 21. This insertion state is shown in FIG. 6, where the arrow X indicates the insertion direction. When the cleaning portion 41 is further inserted from this state, the end of the cleaning portion 41 first reaches the contact location F2 of the second toner layer control blade 24 and the developer roller 21 (see FIG. 6). At this time, the support body 45, which is the substrate of the cleaning portion 41, is formed from flexible thin plate stainless steel (0.1 mm), and is curved such that it can easily follow the surface of the development roller 21, so the end of the cleaning portion 41 smoothly penetrates into the contact location F2 between the second toner layer control blade 24 and the developer roller 21.

When the cleaning portion 41 is further inserted, the end of the cleaning portion 41 next reaches the contact location F1 of the first toner layer control blade 23 and the developer roller 21, and smoothly penetrates into this contact location F1. As shown in FIG. 7, when the end of the cleaning portion 41 penetrates a set length into the contact location F1 of the first toner layer control blade 23 and the developer roller 21, the stepped portion 54 of the lower gripping portion 51 fits together with the lower frame portion 20*d*, and the upper front end face 53 makes contact with the upper frame portion 20*c*.

That is, by inserting the cleaning portion 41 until the gripping portion 51 makes contact with the upper and lower frame portions of the development tank 20, the penetration position of the cleaning portion 41, inserted to the contact locations F1 and F2, is determined. At this time, that disposed position is set such that the respective cushioning material 47*a* and 47*b* is positioned at the bent portion 23*a* that is the contact location with the first toner layer control blade 23 and the curved end portion 24*a* that is the contact location with the second toner layer control blade 24.

Also, the length of the cleaning portion 41 is set to a length such that its end portion does not reach the surface of the toner supply roller 22. This is so that the end of the cleaning portion 41 does not hit the surface of the toner supply roller 22 and cause damage, since that surface is formed with conductive urethane rubber as described above.

That is, the gripping portion 51 not only has a gripping function for a worker to operate the cleaning portion 41 by gripping the gripping portion 51, it also has the role of positioning the penetration position of the cleaning portion 41.

In this state (the state shown in FIG. 7), a worker slides the blade cleaning jig 4 in the widthwise direction of the development roller 21 (direction of rotating shaft core, not shown). It is sufficient to slide the blade cleaning jig 4 back and forth one time. Thus, toner affixed to the bent portion 23*a* of the first toner layer control blade 23 and the bent end portion 24*a* of the second toner layer control blade 24 is removed by the polishing body (polishing tape) of the cleaning portion 41, and afterward good image formation becomes possible.

In the above embodiments, a structure was described in which both the front end portion 53 of the upper side of the gripper 51 and the lower stepped portion 54 make contact with the upper frame portion 20*c* of the development tank 20 and the lower frame portion 20*d* respectively, but a structure may also be adopted in which contact is only made with either the upper frame portion 20*c* or the lower frame portion 20*d*, as long as it is possible to determine the insertion position of the cleaning portion 41.

Also, in the above embodiments, a case was described in which two toner layer control blades are provided, but when only the first toner layer control blade 23 is provided, in the cushioning portion 41 cushioning material may be provided at only the position corresponding to the first toner layer control blade 23.

Further, in the above embodiments, when using the blade cleaning jig 4, it was used with the development tank 20 as-is (that is, in a state containing toner), but a configuration may also be adopted in which first the development apparatus 2 itself is reversed or the like, toner within the development tank 20 is returned to the toner cartridge 19, and the cleaning work is performed after toner is eliminated from within the development tank 20. With this configuration, when sliding the blade cleaning jig 4, the blade cleaning jig 4 does not receive an unnecessary load from toner in the development tank 20, so it is possible to smoothly perform the cleaning work, and moreover it is possible to more effectively remove affixed toner.

Figure 8:
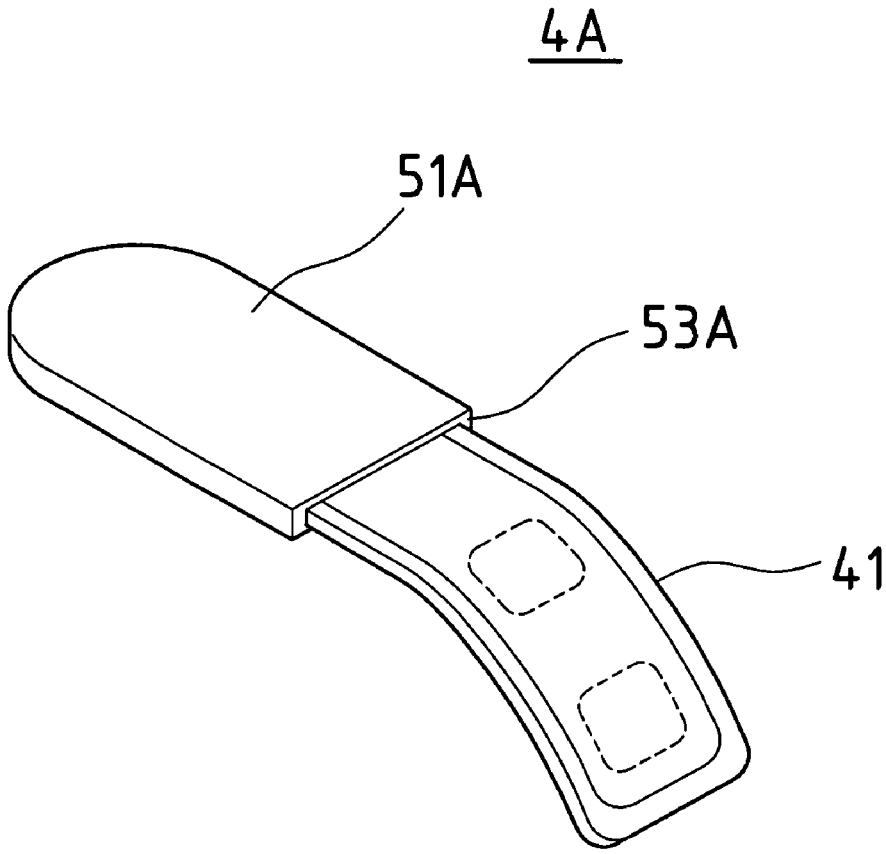
FIG. 8 is a perspective view that shows another embodiment of the blade cleaning jig.

FIG. 8 shows a blade cleaning jig 4A, which is another embodiment. In this embodiment, the gripping portion 51 shown in FIG. 2 is simplified. That is, the gripping portion 51A is simply a bar-like flat plate only for gripping, and the base end portion of the cleaning portion 41 is inserted and fixed to the front end face 53A of the blade cleaning jig 4A as a single body.

In the blade cleaning jig 4A with such a shape, same as in the above embodiments, when the cleaning portion 41 is deeply inserted from the space between the opening portion 20*a* of the development tank 20 and the developer roller 21, the front end face 53A of the gripping portion 51A makes contact with the end portion of the upper curved frame portion 20*b*, and thus the penetration position of the cleaning portion 4 is determined.

The blade cleaning jig is suitably used when removing toner affixed to a toner layer control blade of a development apparatus installed in an image forming apparatus such as a copier, printer, or facsimile machine that forms an image by electrophotography.

The present technology may be embodied in various other forms without departing from the gist or essential characteristics thereof. The embodiments disclosed in this application are to be considered in all respects as illustrative and not limiting. The scope of the technology is indicated by the appended claims rather than by the foregoing description, and all modifications or changes that come within the meaning and range of equivalency of the claims are intended to be embraced therein.

What is claimed is:

1. A blade cleaning jig that removes toner affixed to a toner layer control blade that controls the thickness of a toner layer on the surface of a developer support by pressing against the surface of the developer support, the blade cleaning jig comprising:

a cleaning portion that is inserted from a space between an opening portion of a housing that supports the developer support and the developer support and penetrates to a contact location where the toner layer control blade contacts the developer support, wherein the cleaning portion comprises a flexible support body that is curved along its length to generally conform to a curved exterior surface of the developer support, and a polishing body provided on an upper face of the support body at a location where contact is made with the toner layer control blade; and a gripping portion that is attached to a base of the cleaning portion.

2. The blade cleaning jig according to claim 1, wherein cushioning material is inserted between the support body and the polishing body.

3. The blade cleaning jig according to claim 2, wherein the cushioning material is provided on the support body directly under the polishing body at the location where contact is made with the toner layer control blade.

4. The blade cleaning jig according to claim 3, wherein the support body is an elastic body, the polishing body is polishing tape, and the cushioning material is urethane foam.

5. The blade cleaning jig according to claim 2, wherein the support body is an elastic body, the polishing body is polishing tape, and the cushioning material is urethane foam.

6. The blade cleaning jig according to claim 1, wherein a protective member for preventing damage to the surface of the developer support is attached to the lower face of the support body.

7. The blade cleaning jig according to claim 6, wherein the blade cleaning jig is movable back and forth in the widthwise direction of the developer support in a state with the cleaning portion inserted to the contact location.

8. The blade cleaning jig according to claim 6, wherein the protective member is tape or coating comprising fluorocarbon resin.

9. The blade cleaning jig according to claim 8, wherein the protective member is provided from the lower face of the support body via a circumferential edge portion to an upper face circumferential edge portion of the support body.

10. The blade cleaning jig according to claim 9, wherein the cleaning portion inserted to the contact location is positioned by causing the gripping portion to make contact with the housing in a state with the cleaning portion inserted from the space between the opening portion of the housing and the developer support.

11. The blade cleaning jig according to claim 8, wherein the cleaning portion inserted to the contact location is positioned by causing the gripping portion to make contact with the housing in a state with the cleaning portion inserted from the space between the opening portion of the housing and the developer support.

12. The blade cleaning jig according to claim 8, wherein the blade cleaning jig is movable in back and forth in the widthwise direction of the developer support in a state with the cleaning portion inserted to the contact location.

13. The blade cleaning jig according to claim 6, wherein the protective member is provided from the lower face of the support body via a circumferential edge portion to an upper face circumferential edge portion of the support body.

14. The blade cleaning jig according to claim 13, wherein the cleaning portion inserted to the contact location is positioned by causing the gripping portion to make contact with the housing in a state with the cleaning portion inserted from the space between the opening portion of the housing and the developer support.

15. The blade cleaning jig according to claim 6, wherein the cleaning portion inserted to the contact location is positioned by causing the gripping portion to make contact with the housing in a state with the cleaning portion inserted from the space between the opening portion of the housing and the developer support.

16. The blade cleaning jig according to claim 1, wherein both ends of the support body are rounded.

17. The blade cleaning jig according to claim 16, wherein the cleaning portion inserted to the contact location is positioned by causing the gripping portion to make contact with the housing in a state with the cleaning portion inserted from the space between the opening portion of the housing and the developer support.

18. The blade cleaning jig according to claim 1, wherein the cleaning portion inserted to the contact location is positioned by causing the gripping portion to make contact with the housing in a state with the cleaning portion inserted from the space between the opening portion of the housing and the developer support.

19. The blade cleaning jig according to claim 1, wherein the blade cleaning jig is movable back and forth in the widthwise direction of the developer support in a state with the cleaning portion inserted to the contact location.

20. The blade cleaning jig according to claim 1, wherein the polishing body is provided at first and second locations on the upper face of the support body that correspond to locations where first and second toner layer control blades contact the developer support.

21. A blade cleaning jig that removes toner affixed to a toner layer control blade that controls the thickness of a toner layer on the surface of a developer support by pressing against the surface of the developer support, the blade cleaning jig comprising:

a gripping portion; and a cleaning portion that is attached to and that extends from the gripping portion, wherein the cleaning portion is configured to be inserted between the developer support and the toner layer control blade at a contact location where the toner layer control blade contacts the developer support, wherein the cleaning portion comprises:

a flexible support body;

a polishing body provided on an upper face of the support body at a location corresponding to the location where contact is made between the developer support and the toner layer control blade; and a cushioning material that is inserted between the support body and the polishing body.

22. A blade cleaning jig that removes toner affixed to first and second toner layer control blades that control the thickness of a toner layer on the surface of a developer support by pressing against the surface of the developer support, the blade cleaning jig comprising:

a gripping portion; and a cleaning portion that is attached to and that extends from the gripping portion, wherein the cleaning portion is configured to be inserted between the developer support and the first and second toner layer control blades at first and second contact locations where the toner layer control blades contact the developer support, wherein the cleaning portion comprises:

a flexible support body; and at least one polishing body provided on an upper face of the support body at locations corresponding to the first and second contact locations.

23. The blade cleaning jig according to claim 22, wherein the cleaning portion further comprises first and second cushioning portions that are inserted, respectively, between the support body and the at least one polishing body at the first and second contact locations, respectively.

24. A blade cleaning jig that removes toner affixed to a toner layer control blade that control the thickness of a toner layer on the surface of a developer support by pressing against the surface of the developer support, the blade cleaning jig comprising:

a gripping portion; and a cleaning portion that is attached to and that extends from the gripping portion, wherein the cleaning portion is configured to be inserted between the developer support and the toner layer control blade at a contact location where the toner layer control blade contacts the developer support, wherein the cleaning portion comprises:

a flexible support body;

a polishing body provided on an upper face of the support body at a location corresponding to the contact location; and a protective member attached to a lower surface of the support body, the protective member preventing damage to a surface of the developer support, wherein the protective member extends up around peripheral edges of the support body.

* * * * *